US005806142A

United States Patent [19]

Wang

[11] Patent Number: 5,806,142

[45] Date of Patent: Sep. 15, 1998

[54] HANDLE ASSEMBLY FOR A SUITCASE

[76] Inventor: Jing Sheng Wang, No. 569, Ging Guo Road, Da Gia Town, Taichung Hsien, Taiwan

[21] Appl. No.: 655,946

[22] Filed: May 31, 1996

[51] Int. Cl.[6] ..... A45C 5/14; A45C 13/22; B25G 1/04

[52] U.S. Cl. ..... 16/115; 190/115

[58] Field of Search ..... 16/115; 190/18 A, 190/115; 280/47.315, 47.371, 655, 655.1

[56] References Cited

U.S. PATENT DOCUMENTS

| | | | |
|---|---|---|---|
| 4,974,871 | 12/1990 | Mao | 16/115 |
| 5,374,073 | 12/1994 | Hsin | 16/115 |
| 5,499,426 | 3/1996 | Hsieh | 16/115 |
| 5,515,576 | 5/1996 | Tsai | 16/115 |
| 5,526,908 | 6/1996 | Wang | 16/115 |
| 5,613,273 | 3/1997 | Tsai | 16/115 |

*Primary Examiner*—Chuck Mah
*Assistant Examiner*—Donald M. Gurley
*Attorney, Agent, or Firm*—Charles F. Baxley, Esq.

[57] ABSTRACT

A handle for a suitcase includes a base having two barrels disposed in the end portions for slidably receiving two tubes. A plate is secured to the bottom of the base and two slides are slidably engaged in the plate. The slides each has a latch for engaging with the tubes and each includes an inclined slot. A knob includes two inclined legs engaged with the inclined slots of the slides. The slides are moved toward each other or moved away from each other by the engagement of the inclined legs of the knob with the inclined slots of the slides.

3 Claims, 3 Drawing Sheets

HANDLE ASSEMBLY FOR A SUITCASE

BACKGROUND OF THE INVENTION

1. Field of the Invention

The present invention relates to a handle, and more particularly to a handle for a suitcase and a luggage.

2. Description of the Prior Art

Typical suitcases and luggages comprise a handle that is retractable outward of the body for carrying the suitcase and the luggage. However, the handle normally includes a complicated configuration that may not be easily manufactured and assembled.

The present invention has arisen to mitigate and/or obviate the afore-described disadvantages of the conventional handles for suitcases and luggages.

SUMMARY OF THE INVENTION

The primary objective of the present invention is to provide a handle for a suitcase and a luggage in which the handle includes a simplified configuration that is excellent for manufacturing and assembling purposes.

In accordance with one aspect of the invention, there is provided a handle assembly for a suitcase comprising a base including two ends each having a barrel provided therein, and including a center portion having an opening formed therein, and including a bottom portion, two tubes slidably received and engaged in the barrels of the base, the tubes including a hand grip provided on top thereof and each including at least one hole formed therein, a plate secured to the bottom of the base and including a passage provided therein, two slides slidably engaged in the passage of the plate and each including a latch extended therefrom for engaging with the holes of the tubes, the slides each including an inclined slot formed therein, a knob slidably engaged in the opening of the base and including two inclined legs extended therefrom for engaging with the inclined slots of the slides so as to form a sliding engagement therebetween, and means for biasing the knob away from the slides and for biasing the knob upward through the opening. The slides are caused to move toward each other by the sliding engagement between the inclined legs of the knob and the inclined slots of the slides in order to disengage the latches from the holes of the tubes and in order to allow the tubes to slide relative to the barrels of the base when the knob is depressed downward against the biasing means, and the slides are moved away from each other by the sliding engagement between the inclined legs of the knob and the inclined slots of the slides in order to engage the latches of the slides with the holes of the tubes when the knob is released and when the knob is biased away from the slides.

The plate includes a pair of spaced longitudinal walls so as to form the passage therebetween for slidably receiving the slides, the walls each includes a middle portion having a pair of ribs extended therefrom so as to define a channel therein, the knob includes two fins extended downward therefrom for slidably engaging with the channels of the plate so as to guide the knob to move upward and downward relative to the base.

The plate includes a center portion having a post extended upward therefrom, the biasing means includes a spring engaged on the post, the knob includes a stud extended downward therefrom for engaging with the spring and the post.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 3:
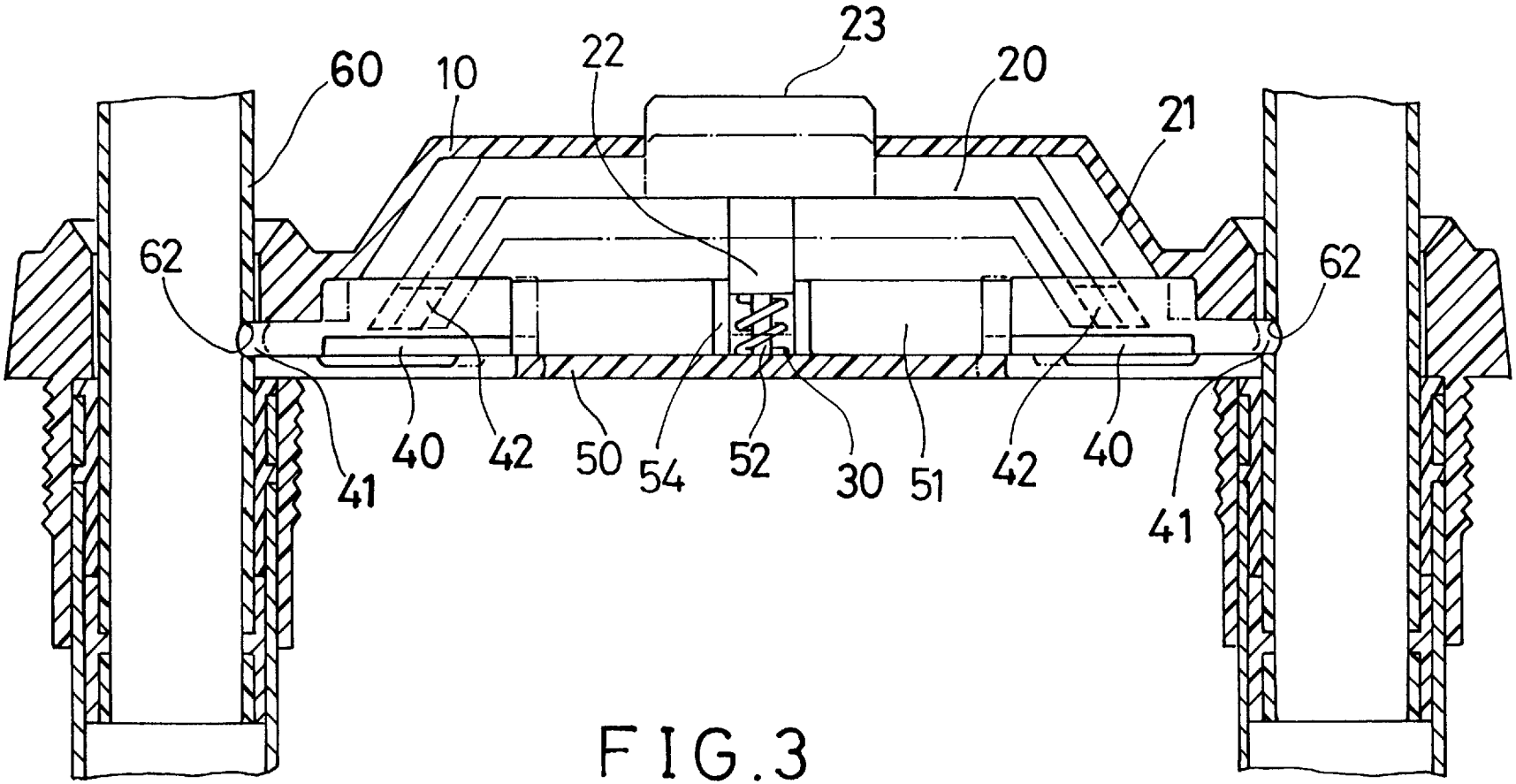
FIG. 3 is a cross sectional view taken along lines 2—2 of FIG. 1.

Referring to the drawings, a handle assembly for a suitcase or a luggage in accordance with the present invention comprises a base 10 including two barrels 11 provided on the end portions for slidably receiving two tubes 60 therein respectively. The tubes 60 include a hand grip 61 provided on top thereof and each includes at least one hole 62 formed therein (FIG. 3). The base 10 includes an opening 14 formed in the center portion thereof. A plate 50 is secured to the bottom of the base 10 and includes a pair of spaced longitudinal walls 55 so as to form a passage 51 therebetween. The walls 55 each includes two ribs 54 extended from the middle portion so as to define a channel 58 therein. The plate 50 includes a post 52 extended upward from the center portion for engaging with a spring 30 thereon. The plate 50 includes two ends-each having a stop member 53 provided therein.

Two slides 40 are slidably engaged in the passage 51 and each includes a latch 41 extended therefrom and each includes an inclined slot 42 formed therein. The stops 53 may engage with the slides 40 so as to prevent the slides 40 from being disengaged from the plate 50. A knob 23 is slidably engaged in the opening 14 of the base 10 and movable outward beyond the base 10 via the opening 14. The knob 23 includes a bar 20 disposed above the slides 40 and includes a stud 22 extended downward therefrom for engaging with the spring 30 and the post 52 and includes two fins 24 extended downward from the side portions for slidably engaging with the channels 58 of the plate 50 such that the board 20 and the knob 23 can be caused to move upward and downward relative to the base 10. The knob 23 includes two inclined legs 21 extended therefrom for engaging with the inclined slots 42 of the slides 40. The spring 30 may bias the knob 23 outward through the opening 14.

In operation, as shown in FIG. 3, when the knob 23 is depressed downward against the spring 30, the slides 40 are caused to move toward each other by the sliding engagement between the inclined legs 21 of the knob 23 and the inclined slots 42 of the slides 40. The latches 41 of the slides 40 are thus be disengaged from the holes 62 of the tubes 60 such that the tubes 60 are allowed to slide relative to the barrels 11 of the base 10. When the knob 23 is released, the spring 30 may bias the knob 23 upward through the opening 14. The slides 40 are thus be moved away from each other by the sliding engagement between the inclined legs 21 of the knob 23 and the inclined slots 42 of the slides 40 such that the latches 41 of the slides 40 may be caused to engage with the holes 62 of the tubes 60 in order to latch and to lock the tubes 60 in place.

It is to be noted that the knob 23 can be easily engaged with the opening 14, and the slides 40 may be easily engaged with the legs 21 and may be easily retained in place by the plate 50. The spring 30 may also be easily engaged on the post 52. The latches 41 of the slides 40 may be easily caused to engage with the tubes 60 by the spring 30 when the knob 23 is released.

Figure 1:
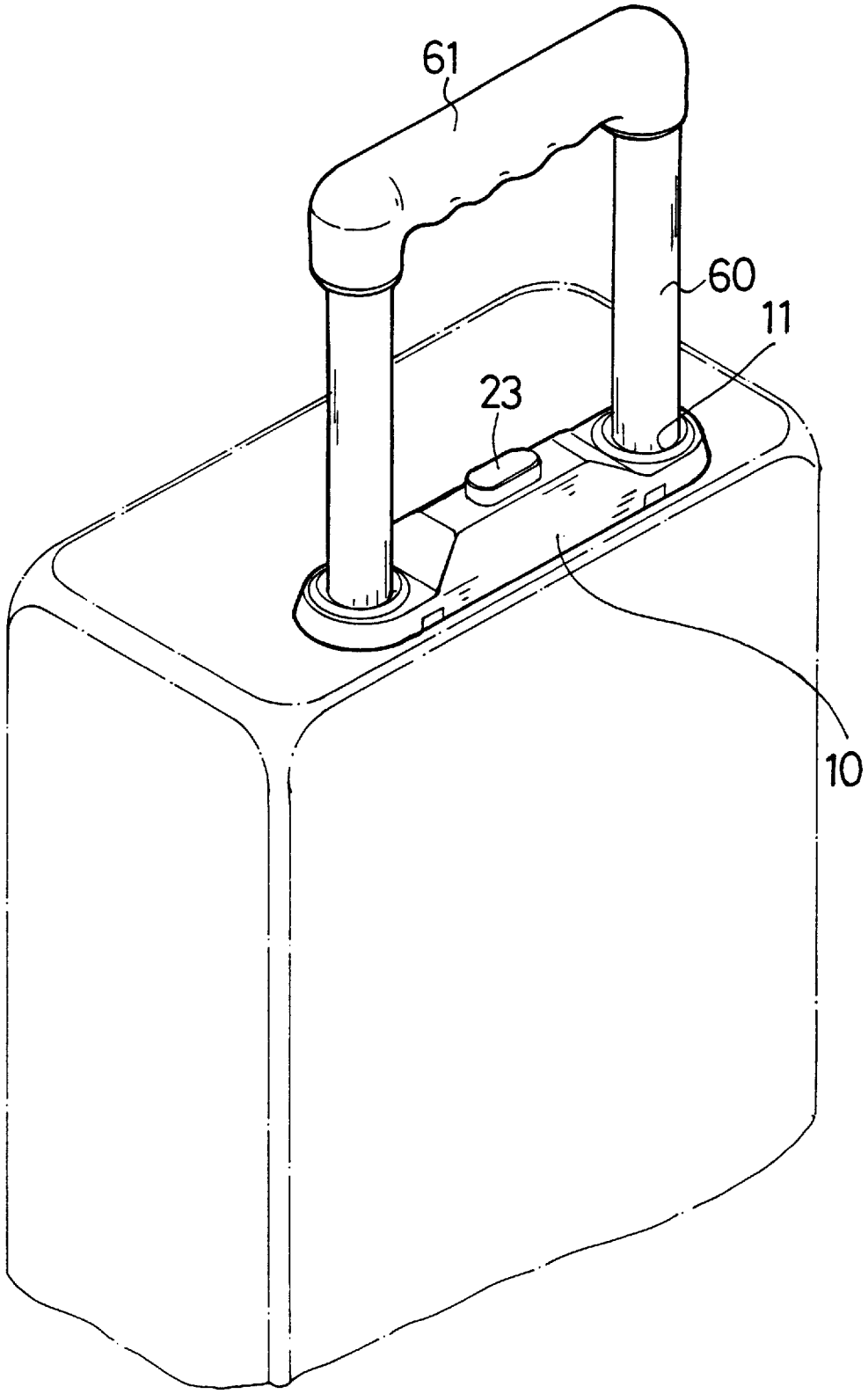
FIG. 1 is a perspective view of a handle for a suitcase in accordance with the present invention.
Figure 2:
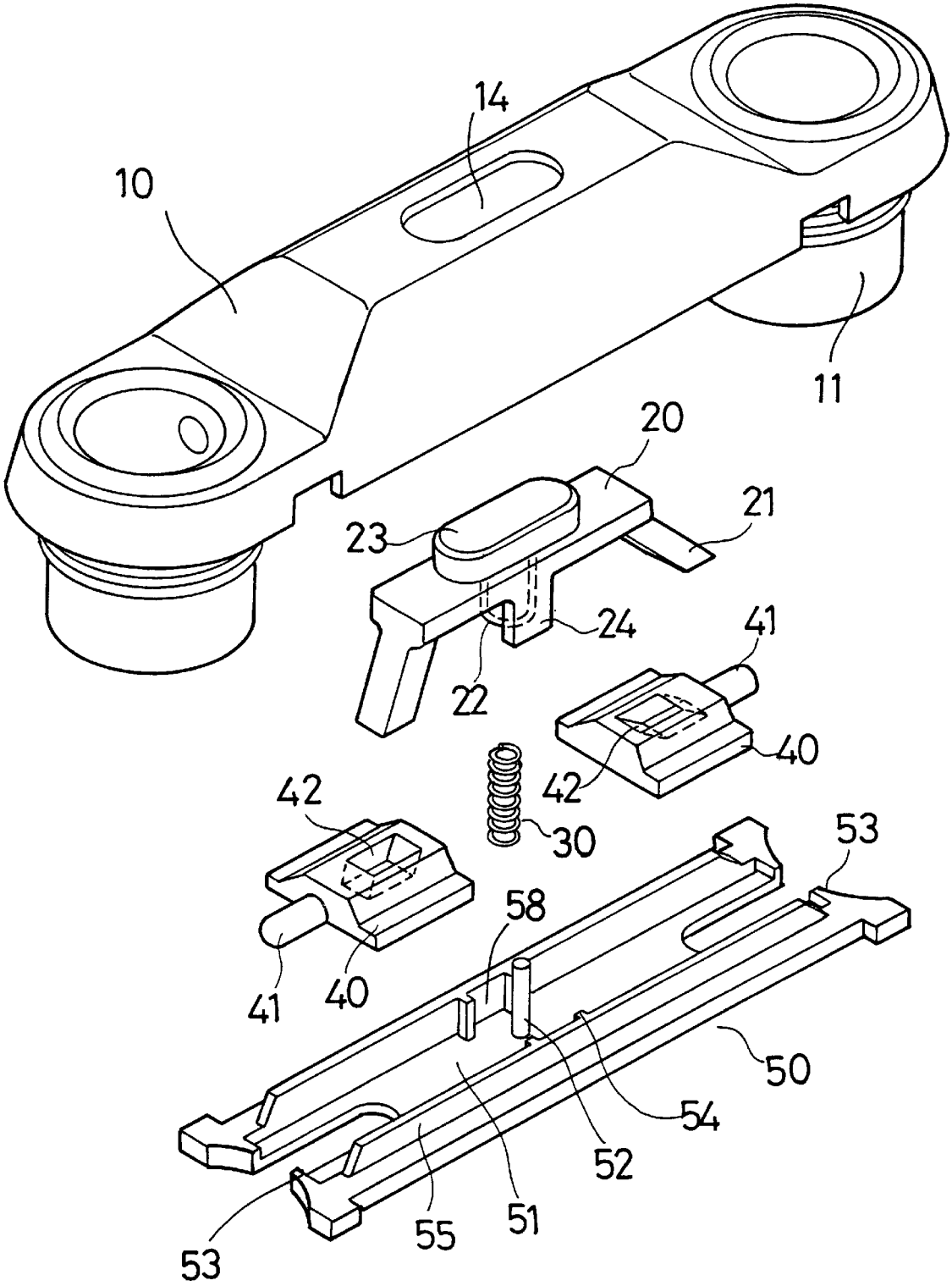
FIG. 2 is an exploded view of the handle.

Alternatively, the legs 21 and the slots 42 may be inclined inward toward each other instead of inclined outward as shown in FIGS. 2 and 3. In this condition, the slides 40 may be moved toward each other when the knob 23 is biased upward through the opening 14 by the spring 30; and the slides 40 may be moved away from each other when the knob 23 is depressed downward and inward of the base 10.

Accordingly, the handle assembly in accordance with the present invention includes a simplified configuration that is excellent for manufacturing and assembling purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A handle assembly for a suitcase comprising:

a base including two ends each having a barrel provided therein, and including a center portion having an opening formed therein, and including a bottom portion, two tubes slidably received and engaged in said barrels of said base, said tubes including a hand grip provided on top thereof and each including at least one hole formed therein, a plate secured to said bottom portion of said base and including a passage provided therein, two slides slidably engaged in said passage of said plate and each including a latch extended outwardly therefrom for engaging with said holes of said tubes, said slides each including an inclined slot formed therein, each inclined slot having spaced-apart, parallel, inclined inner and outer facing walls for receiving a similarly inclined leg, a knob slidably engaged in said opening of said base and including two inclined legs extended therefrom for engaging with said inclined slots of said slides so as to form a sliding engagement therebetween, each inclined leg having spaced-apart, parallel, inclined outer and inner facing surfaces cooperating with said inner and outer facing walls, respectively, of said slot; and means for biasing said knob away from said slides and for biasing said knob upward through said opening, said slides being caused to move inwardly toward each other by the sliding engagement between said inclined legs of said knob and said inclined slots of said slides in order to disengage said latches from said holes of said tubes and in order to allow said tubes to slide relative to said barrels of said base when said knob is depressed downward against said biasing means, and said slides being outwardly moved away from each other by the sliding engagement between said inclined legs of said knob and said inclined slots of said slides in order to engage said latches of said slides with said holes of said tubes when said knob is released and when said knob is biased away from said slides.

2. A handle assembly according to claim 1, wherein said plate includes a pair of spaced longitudinal walls so as to form said passage therebetween for slidably receiving said slides, said walls each includes a middle portion having a pair of ribs extended therefrom so as to define a channel therein, said knob includes two fins extended downward therefrom for slidably engaging with said channels of said plate so as to guide said knob to move upward and downward relative to said base.

3. A handle assembly according to claim 1, wherein said plate includes a center portion having a post extended upward therefrom, said biasing means includes a spring engaged on said post, said knob includes a stud extended downward therefrom for engaging with said spring and said post.

* * * * *